US005782023A

United States Patent [19]

Iannantuano et al.

[11] Patent Number: 5,782,023

[45] Date of Patent: Jul. 21, 1998

[54] FIBER OPTIC TRADING CARD SYSTEM

[76] Inventors: Jaime Iannantuano; Theresa Iannantuano, both of 610 Columbia Ave., North Bergen, N.J. 07047

[21] Appl. No.: 764,064

[22] Filed: Nov. 6, 1996

[51] Int. Cl.[6] ..... G09F 13/00

[52] U.S. Cl. ..... 40/124.02; 40/547; 362/32; 362/812

[58] Field of Search ..... 40/124.02, 547; 362/32, 812

[56] References Cited

U.S. PATENT DOCUMENTS 3,184,872 5/1965 Way ..... 40/547 X 4,807,092 2/1989 Hasegawa ..... 362/32

*Primary Examiner*—Cassandra Davis

[57] ABSTRACT

A new Fiber Optic Trading Card System for illuminating selected portions of a card, such as a trading card, thereby enhancing the images to create life like features. The trading card system includes a stratified card having an image layer, an opaque layer having a plurality of channels and apertures where fiber optic cables project through, a multi-colored layer juxtaposed to the opaque layer, and a transparent protective layer juxtaposed to the multi-colored layer where light projects through the transparent protective layer through the multi-colored layer into selected fiber optic cables and is emitted through the image layer according to the position of the fiber optic cables within the opaque layer.

4 Claims, 3 Drawing Sheets

FIBER OPTIC TRADING CARD SYSTEM

BACKGROUND OF THE INVENTION

1. Field of the Invention

The present invention relates to Fiber Optic Devices and more particularly pertains to a new Fiber Optic Trading Card System for illuminating selected portions of a card, such as a trading card, thereby enhancing the images to create life like features.

2. Description of the Prior Art

The use of Fiber Optic Devices is known in the prior art. More specifically, Fiber Optic Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Fiber Optic Devices include U.S. Pat. No. 5,010,673; U.S. Pat. No. 4,917,448; U.S. Design Pat. No. 346,829; U.S. Pat. No. 4,417,412; U.S. Pat. No. 5,087,145 and U.S. Pat. No. 4,929,048.

While these devices fulfill their respective, particular objectives and requirements, the aforementioned patents do not disclose a new Fiber Optic Trading Card System. The inventive device includes a stratified card having an image layer, an opaque layer having a plurality of channels and apertures where fiber optic cables project through, a multi-colored layer juxtaposed to the opaque layer, and a transparent protective layer juxtaposed to the multi-colored layer where light projects through the transparent protective layer through the multi-colored layer into selected fiber optic cables and is emitted through the image layer according to the position of the fiber optic cables within the opaque layer.

In these respects, the Fiber Optic Trading Card System according to the present invention substantially departs from the conventional concepts and designs of the prior art, and in so doing provides an apparatus primarily developed for the purpose of illuminating selected portions of a card, such as a trading card, thereby enhancing the images to create life like features.

SUMMARY OF THE INVENTION

In view of the foregoing disadvantages inherent in the known types of Fiber Optic Devices now present in the prior art, the present invention provides a new Fiber Optic Trading Card System construction wherein the same can be utilized for illuminating selected portions of a card, such as a trading card, thereby enhancing the images to create life like features.

The general purpose of the present invention, which will be described subsequently in greater detail, is to provide a new Fiber Optic Trading Card System apparatus and method which has many of the advantages of the Fiber Optic Devices mentioned heretofore and many novel features that result in a new Fiber Optic Trading Card System which is not anticipated, rendered obvious, suggested, or even implied by any of the prior art Fiber Optic Devices, either alone or in any combination thereof.

To attain this, the present invention generally comprises a stratified card having an image layer, an opaque layer having a plurality of channels and apertures where fiber optic cables project through, a multi-colored layer juxtaposed to the opaque layer, and a transparent protective layer juxtaposed to the multi-colored layer where light projects through the transparent protective layer through the multi-colored layer into selected fiber optic cables and is emitted through the image layer according to the position of the fiber optic cables within the opaque layer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Fiber Optic Trading Card System apparatus and method which has many of the advantages of the Fiber Optic Devices mentioned heretofore and many novel features that result in a new Fiber Optic Trading Card System which is not anticipated, rendered obvious, suggested, or even implied by any of the prior art Fiber Optic Devices, either alone or in any combination thereof.

It is another object of the present invention to provide a new Fiber Optic Trading Card System which may be easily and efficiently manufactured and marketed.

It is a further object of the present invention to provide a new Fiber Optic Trading Card System which is of a durable and reliable construction.

An even further object of the present invention is to provide a new Fiber Optic Trading Card System which is susceptible of a low cost of manufacture with regard to both materials and labor, and which accordingly is then susceptible of low prices of sale to the consuming public, thereby making such Fiber Optic Trading Card System economically available to the buying public.

Still yet another object of the present invention is to provide a new Fiber Optic Trading Card System which provides in the apparatuses and methods of the prior art some of the advantages thereof, while simultaneously overcoming some of the disadvantages normally associated therewith.

Still another object of the present invention is to provide a new Fiber Optic Trading Card System for illuminating selected portions of a card, such as a trading card, thereby enhancing the images to create life like features.

Yet another object of the present invention is to provide a new Fiber Optic Trading Card System which includes a stratified card having an image layer, an opaque layer having a plurality of channels and apertures where fiber optic cables project through, a multi-colored layer juxtaposed to the opaque layer, and a transparent protective layer juxtaposed to the multi-colored layer where light projects through the transparent protective layer through the multi-colored layer into selected fiber optic cables and is emitted through the image layer according to the position of the fiber optic cables within the opaque layer.

Still yet another object of the present invention is to provide a new Fiber Optic Trading Card System that increases the aesthetics of a trading card.

Even still another object of the present invention is to provide a new Fiber Optic Trading Card System that does not require a power source to illuminate portions of the card.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
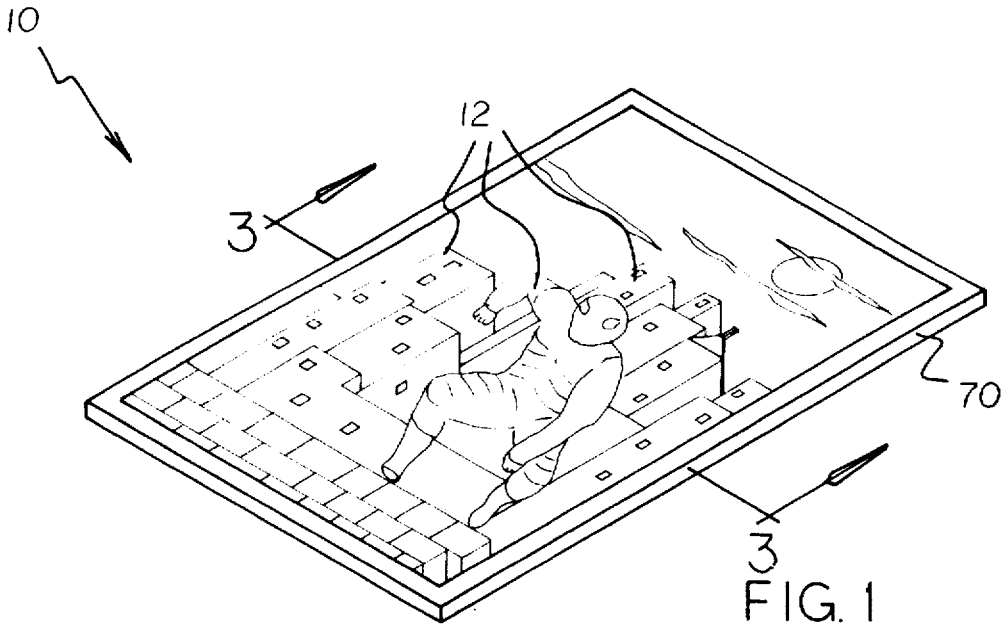
FIG. 1 is a perspective view of a new Fiber Optic Trading Card System according to the present invention.

With reference now to the drawings, and in particular to FIGS. 1 through 6 thereof, a new Fiber Optic Trading Card System embodying the principles and concepts of the present invention and generally designated by the reference numeral 10 will be described.

More specifically, it will be noted that the Fiber Optic Trading Card System 10 comprises a stratified card having an image layer 20, an opaque layer 30 having a plurality of cable channels 34 and apertures 36 where fiber optic cables 32 project through, a multi-colored layer 40 juxtaposed to the opaque layer 30, and a transparent protective layer 50 juxtaposed to the multi-colored layer 40 where light projects through the transparent protective layer 50 through the multi-colored layer 40 into selected fiber optic cables 32 and is emitted through the image layer 20 according to the position of the fiber optic cables 32 within the opaque layer 30.

Figure 2:
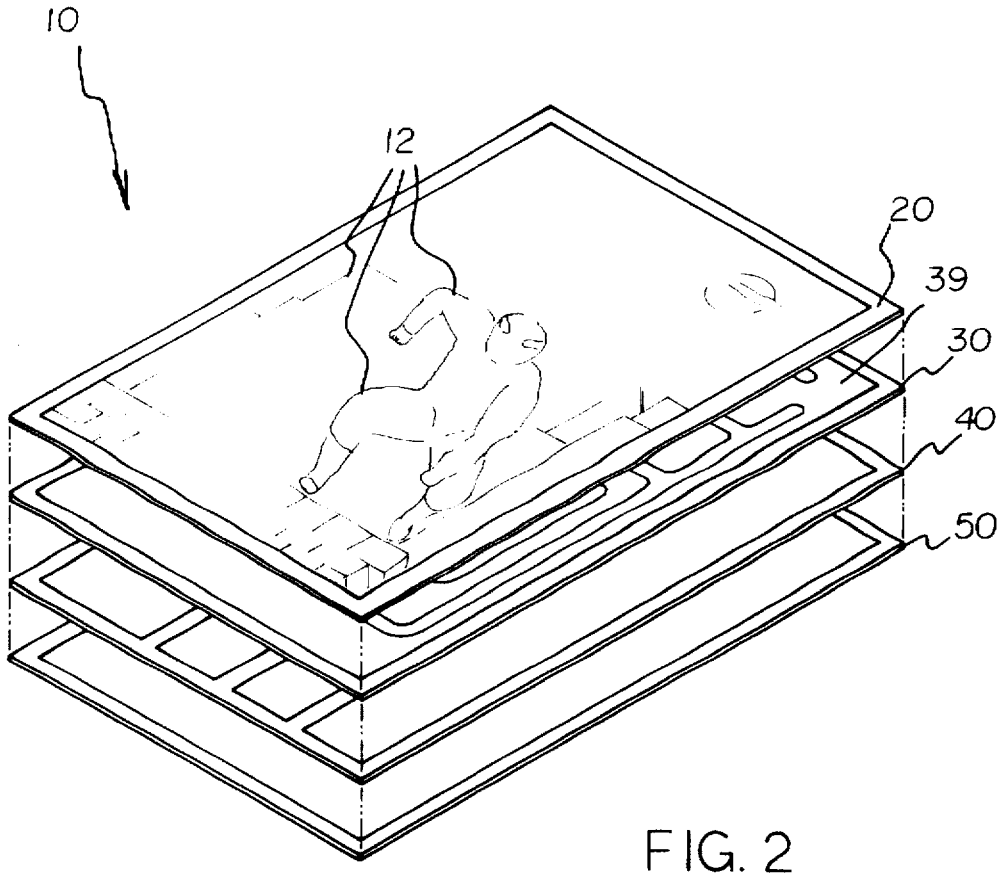
FIG. 2 is an exploded perspective view of the present invention.
Figure 3:
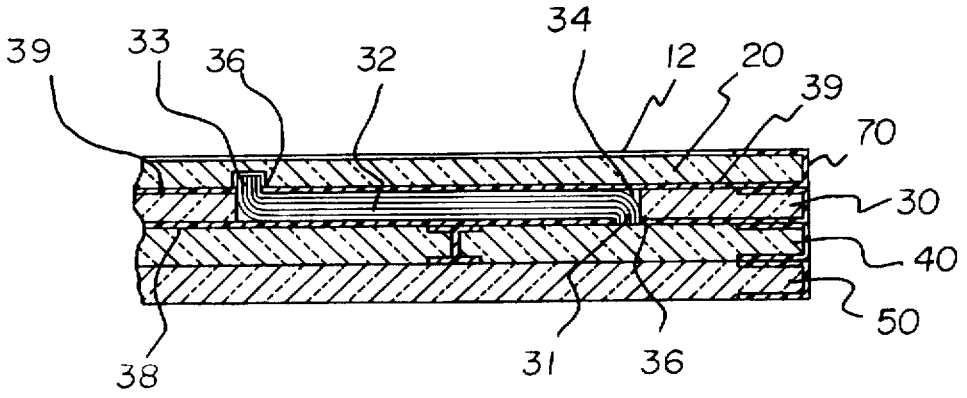
FIG. 3 is a cross sectional view taken along line 3—3 of FIG. 1.
Figure 4:
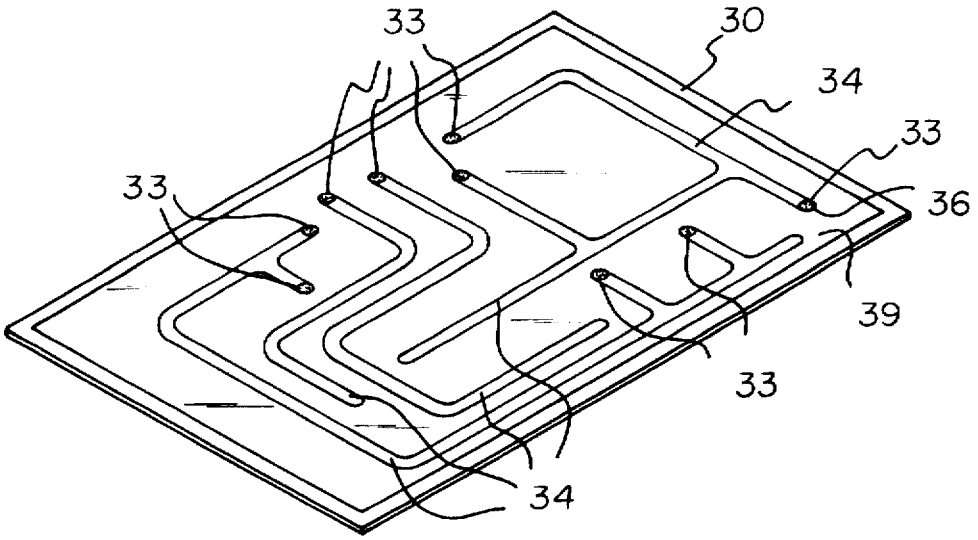
FIG. 4 is an upper perspective view of the opaque layer with the fiber optic cables.
Figure 5:
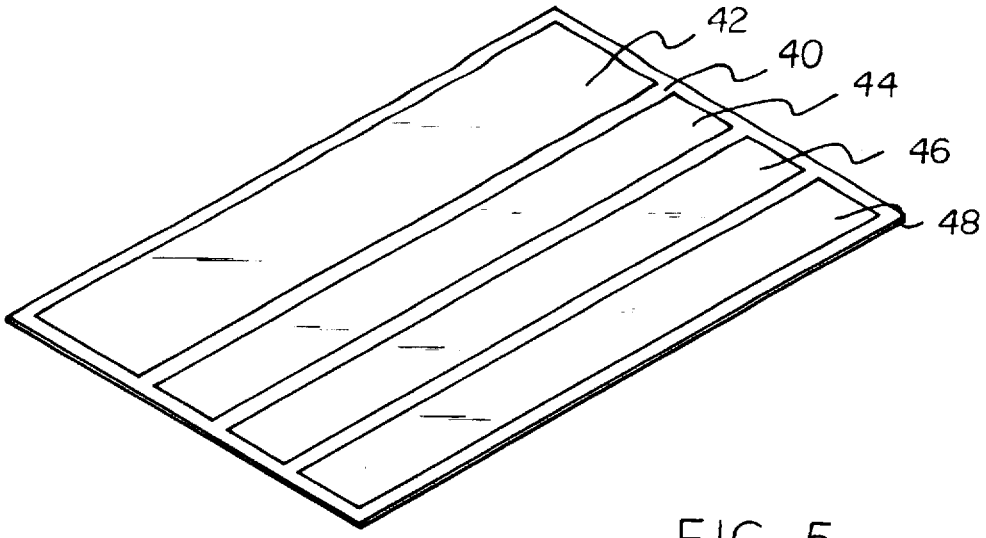
FIG. 5 is an upper perspective view of the multi-colored layer.
Figure 6:
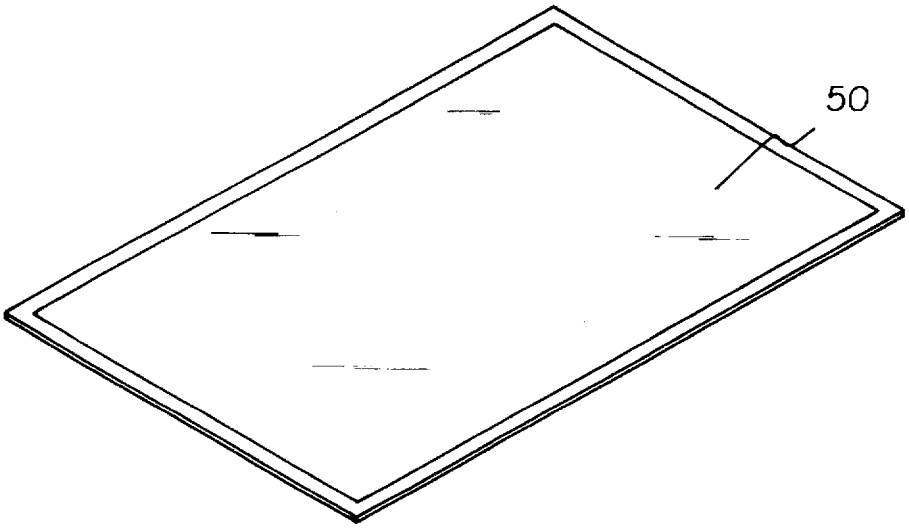
FIG. 6 is an upper perspective view of the transparent protective layer.

As best illustrated in FIGS. 1 and 2, it can be shown that the image layer 20 has an indicia 12. The opaque layer 30 has a first side 38 and a second side 39 as shown in FIGS. 2 through 4. The second side 39 is juxtaposed to the image layer 20 as shown in FIG. 2 of the drawings. The opaque layer 30 has a plurality of apertures 36 into the first side 38 and a plurality of apertures 36 into the second side 39. The apertures 36 into the second side 39 are positioned to correspond to selected lighting situations within the indicia 12 as shown in FIG. 4. The opaque layer 30 has a plurality of cable channels 34 extending between the apertures 36 of the first side 38 and the second side 39 as shown in FIGS. 3 and 4 of the drawings. A plurality of fiber optic cables 32 having a first end 31 and a second end 33 project through the cable channels 34 having various sizes depending on a desired light intensity. As shown in FIG. 3, the first end 31 projects through the aperture 36 into the first side 38. The second end 33 projects through the aperture 36 into the second side 39. The multi-colored layer 40 is juxtaposed to the opaque layer 30 opposite of the image layer 20. The first end 31 receives a selected colored light from the multi-colored layer 40 when positioned near a light source. The second end 33 projects the selected colored light within the indicia 12 to create life like features with various colors and intensities of light. As shown in FIGS. 2 and 6, the transparent layer is juxtaposed to the multi-colored layer 40 forming a protective layer 50. A frame member 70 is preferably secured to a perimeter of the layers 20, 30, 40 and 50 thereby securing the layers 20, 30, 40 and 50 together. The multi-colored layer 40 preferably has at least four different colors distinctly space from one another.

In use, the user positions the present invention near a light source with the transparent protective layer 50 closest to the light source. The light passes through the transparent protective layer 50 then passes through the multi-colored layer 40 which allows only a selected spectrum of light to pass through in various sections of the multi-colored layer 40. The opaque layer 30 prevents any passage of light through it. However, the first end 31 of the fiber optic cables 32 are juxtaposed to the selected color of light and receive the colored light. The fiber optic cables 32 thereafter carry the colored light to the second end 33 where it is emitted through the image layer 20 in selected positions to create the appearance of images with life like features. The emitted light reproduces various light sources or objects such as a sun, street lights, building lights, flashlights, stars, or any other source of light or light reflecting object.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Fiber Optic Trading Card System comprising:

an image layer having an indicia;

a planar opaque layer having a first side and a second side, wherein at least one of said cable channels extends parallel to the plane of said opaque layer said second side juxtaposed to said image layer;

said opaque layer including a plurality of apertures into said first side and a plurality of apertures into said second side, where said apertures into said second side are positioned to correspond to selected lighting situations within said indicia;

said opaque layer including a plurality of cable channels extending between said apertures of said first side and said second side;

a plurality of fiber optic cables having a first end and a second end projecting through said cable channels having various sizes depending on a desired light intensity;

said first end projecting through said aperture into said first side and said second end projecting through said aperture into said second side; and a multi-colored layer juxtaposed to said opaque layer opposite of said image layer, where said first end receives a selected colored light from said multi-colored layer when positioned near a light source and said second end projects said selected colored light within said indicia to create life like features with various colors and intensities of light.

2. The Fiber Optic Trading Card System of claim 1, wherein a transparent layer is juxtaposed to said multi-colored layer forming a protective layer.

3. The Fiber Optic Trading Card System of claim 2, wherein a frame member is secured to a perimeter of said layers thereby securing said layers together.

4. The Fiber Optic Trading Card System of claim 3, wherein said multi-colored layer has at least four different colors.

* * * * *